US006877705B2

(12) United States Patent
Dauer

(10) Patent No.: US 6,877,705 B2
(45) Date of Patent: Apr. 12, 2005

(54) COASTER FOR STEMWARE

(76) Inventor: Nancy Dauer, 111 Oakwood Dr., Bridgewater, VA (US) 22812

( * ) Notice: Subject to any disclaimer, the term of this patent is extended or adjusted under 35 U.S.C. 154(b) by 0 days.

(21) Appl. No.: 10/316,968

(22) Filed: Dec. 11, 2002

(65) Prior Publication Data

US 2003/0122050 A1 Jul. 3, 2003

Related U.S. Application Data

(60) Provisional application No. 60/340,867, filed on Dec. 12, 2001.

(51) Int. Cl.[7] ..... A47G 23/03

(52) U.S. Cl. ..... 248/346.11

(58) Field of Search ..... 248/346.11, 346.01, 248/310, 188.1; 220/574, 575; 383/63; 150/154

(56) References Cited

U.S. PATENT DOCUMENTS 2,131,878 A * 10/1938 Lawrence ..... 215/394
2,163,309 A * 6/1939 McConnell ..... 215/394
2,215,633 A * 9/1940 Campbell ..... 215/394
2,343,287 A * 3/1944 Elsaesser ..... 215/394
2,416,732 A * 3/1947 Brnett ..... 383/43
2,570,954 A * 10/1951 Kasman ..... 215/394
3,109,474 A * 11/1963 Levi ..... 150/158
3,195,847 A * 7/1965 Squires ..... 248/346.11
5,419,455 A * 5/1995 Russeau ..... 220/575
6,578,809 B1 * 6/2003 Dimella ..... 248/346.11

FOREIGN PATENT DOCUMENTS

JP 09084679 A * 3/1997 ..... A47G/23/03

* cited by examiner

*Primary Examiner*—Ramon O. Ramirez
*Assistant Examiner*—Ingrid Weinhold
(74) *Attorney, Agent, or Firm*—Dennis H. Lambert

(57) ABSTRACT

A substantially flat, generally circular coaster made of a material that can absorb and/or prevent transmission of moisture is designed to receive the enlarged base of stemware and to be carried with the stemware, so that the coaster is always in position and ready for use without any handling of the coaster being required by the user after the coaster is initially placed in position on the base of the stemware. The coaster has a bottom portion and a top portion joined at their periphery to define a hollow cavity in which the base of the stemware is received. The top portion is provided with shaped slots or cuts so that the base of the stemware can be inserted through the top portion and into the hollow cavity. In a preferred embodiment, the coaster is made of an attractive fabric material.

11 Claims, 2 Drawing Sheets

COASTER FOR STEMWARE

This application claims the benefit of U.S. provisional patent application Ser. No. 60/340,867, filed Dec. 12, 2001.

BACKGROUND OF THE INVENTION

1 Field of the Invention

This invention relates generally to coasters for use with drinking utensils to prevent dripping of condensation from the utensil and marring of surface finishes on which the utensil may be rested. In particular, the invention relates to a coaster for use with stemware.

2. Prior Art

Coasters are known for placement on a surface so that drinking utensils can be placed on the coaster to avoid wetting and potential damage to the surface when the utensil is set down. While this is generally satisfactory, if a person moves about and carries his or her drink from place to place, a coaster may not be available at the location where the person desires to next set his or her drink down. Also, dripping of condensate or other liquid from the utensil can still take place when the utensil is lifted and moved away from the coaster.

Insulating sleeves or cup-like holders are known for receiving and holding some beverage containers such as, e.g., soda or beer cans. These insulating holders may incidentally function to avoid dripping of moisture from the cans either when the can is set down on a surface or carried from place to place, but that generally is not their intended purpose. Moreover, they are not adapted for nor are they suitable for use with stemware.

Accordingly, there is a need for a coaster for use with stemware that functions to prevent dripping of moisture from the stemware to a surface when the stemware is set on the surface, and also to prevent dripping of moisture from the stemware when the stemware is being carried from place to place.

SUMMARY OF THE INVENTION

The present invention provides a coaster for use with stemware that functions to prevent dripping of moisture from the stemware to a surface when the stemware is set on the surface, and also to prevent dripping of moisture from the stemware when the stemware is being carried from place to place.

In accordance with the invention, a substantially flat, generally circular coaster made of a material that can absorb and/or prevent transmission of moisture is designed to receive the enlarged base of stemware and to be carried with the stemware, whereby the coaster is always in position and ready for use without any handling of the coaster being required by the user after the coaster is initially placed in position on the base of the stemware.

More specifically, the stemware coaster of the invention has a bottom portion and a top portion joined at their periphery to define a hollow cavity therebetween. The top portion is provided with shaped slots or cuts so that the base of the stemware can be inserted through the top portion and into the hollow cavity, whereby the coaster is retained on the base.

In a preferred embodiment, the coaster is made of an attractive fabric material, and can be laundered or cleaned for reuse when it becomes soiled. Alternatively, it can be made disposable. For instance, the coaster could be made of a paper material and thrown away after use. Additionally, the coaster can have decorative designs or other indicia, as desired.

The unique construction of the coaster of the invention enables it to cling to a stemmed beverage container so that the coaster will travel with the container without requiring intervention by the user. The coaster is absorbent to prevent drips from the container, and also functions to protect furniture. It is made from two superimposed circles of fabric with an absorbent backing, secured together at their periphery to leave a hollow cavity between them. The bottom circle is left intact, and the top circle has a shaped cut that allows the base of the container to be slipped into the coaster. The cut defines multiple flaps which open or yield to permit the base of a stemmed container to be slipped beneath them, and then close over the base to hold the coaster in place. In the particular embodiment disclosed herein, three flaps are defined spaced equidistantly around a small center opening.

The coaster is used by slipping the base of a stemmed glass under one flap and then folding back the coaster to allow the edge of the other two flaps to come up and over the top of the base. The base is then eased under the two flaps until the coaster is fitted smoothly onto the base. With the coaster in place, it will travel with the container and no further intervention is required by the user.

Although the coaster is shown and described herein as having a circular shape, it could have other shapes, as desired. For instance, the coaster could be oblong or have an ovoid shape, or it could be square, rectangular, octagonal, hexagonal, or other shapes.

BRIEF DESCRIPTION OF THE DRAWINGS

The foregoing as well as other objects and advantages of the invention will become apparent from the following detailed description when considered in conjunction with the accompanying drawings, wherein like reference characters designate like parts throughout the several views, and wherein.

DETAILED DESCRIPTION OF THE PREFERRED EMBODIMENT

Figure 1:
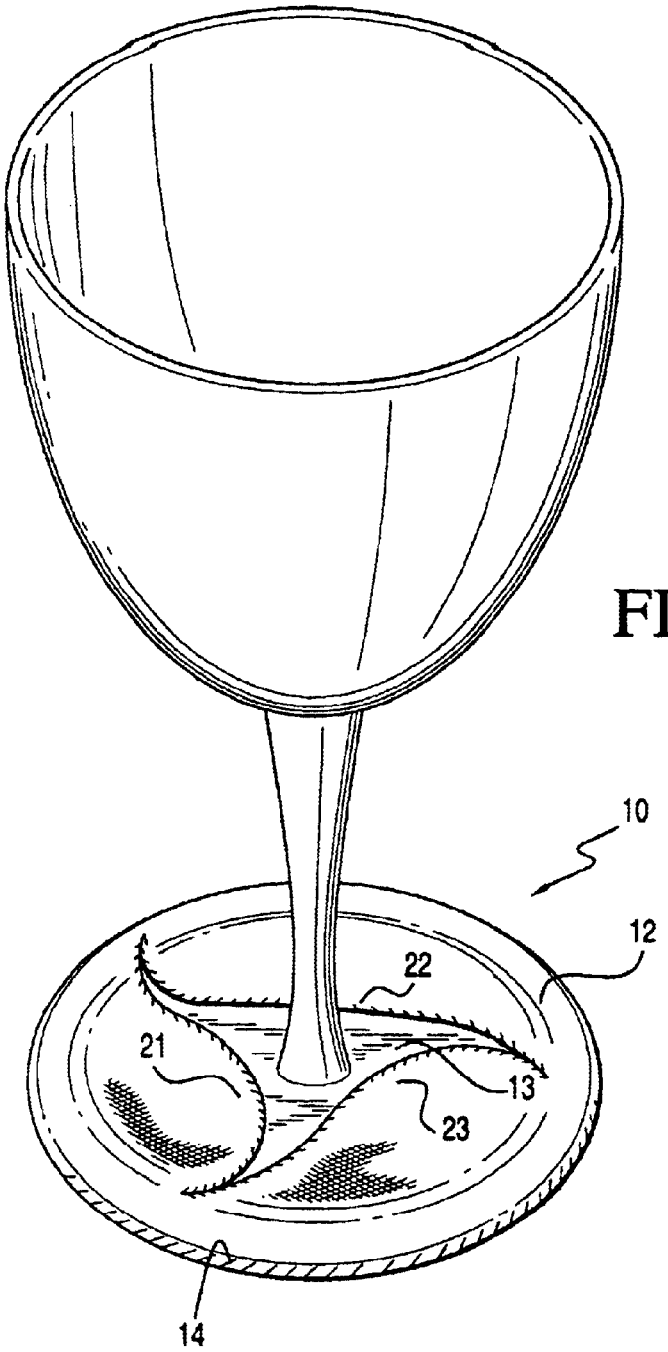
FIG. 1 is a top perspective view of a stemmed beverage container with the coaster of the invention in place on its base.
Figure 2:
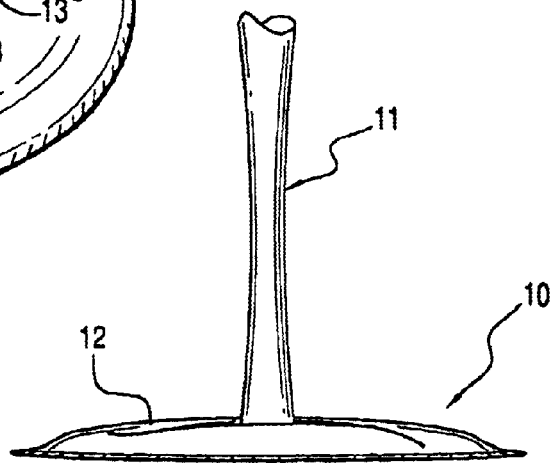
FIG. 2 is a fragmentary side view in elevation of the stem of the container with the coaster in place.
Figure 3:
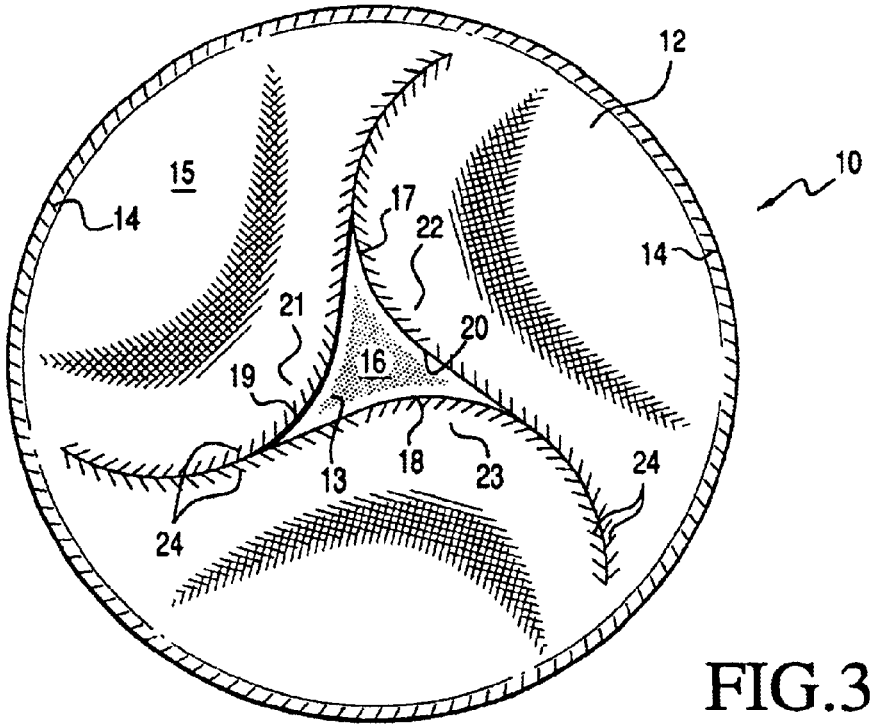
FIG. 3 is a top plan view of the coaster of the invention
Figure 4:
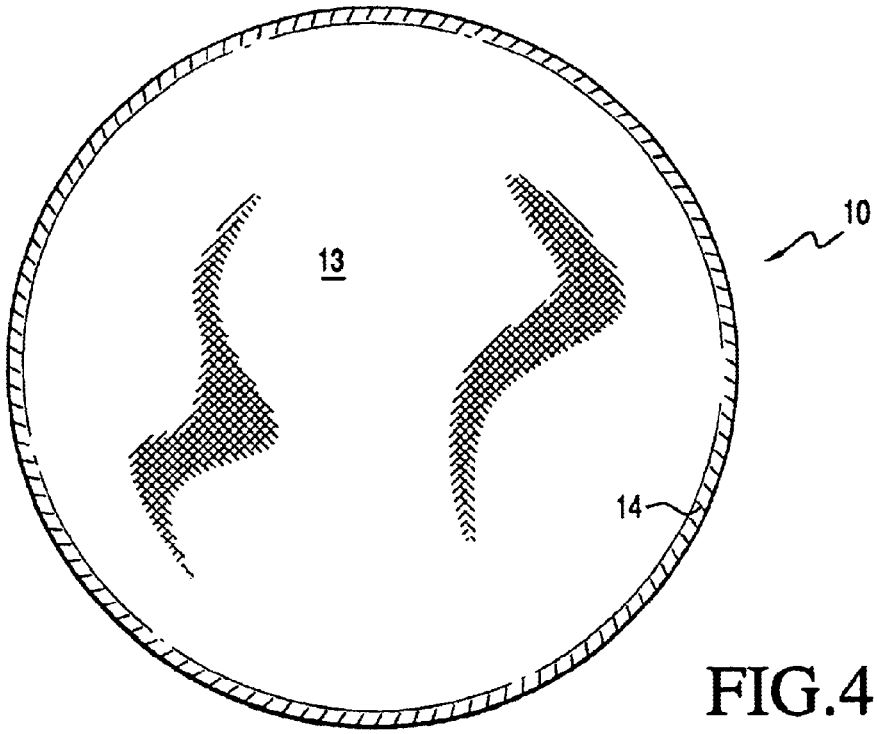
FIG. 4 is a bottom plan view of the coaster

The stemware coaster of the invention is indicated generally at 10 in FIGS. 1 and 2, as it appears when applied to stemmed glassware 11. In the embodiment shown and described, the coaster comprises two circular pieces of material 12 and 13 secured together at their periphery by suitable means, such as stitching 14. Adhesives or other fastening means could be used, as desired or appropriate. For instance, if the coaster is made of paper, adhesive would likely be more appropriate. Moreover, the coaster could be constructed from a single piece of material cut to shape and joined at one point so that it can be folded over upon itself This approach would be especially suitable if the coaster is made of paper.

In the preferred embodiment, the coaster is made from a fabric material having a finished side 15 and an absorbent backing 16 on the other side. The two circles of material are cut from the fabric, and three wave-shaped cuts 17, 18 and 19 are made in one of the circles, oriented to leave an opening 20 in the center. Each wave-shaped cut starts ¼ inch from the edge of the circle, and continues in an arc across the circle so that the back side of the wave curves up toward the center of the circle with the crest of the wave being ¼ inch below the center, and then curling around to finish the wave ¼ inch from the edge of the circle at a point one third of the way around the circumference of the circle from the starting point. Thus, the second cut 18 is started next to the finish of the first cut 17 and ends two thirds of the way around the circle, and the third cut 19 is started next to the finish of the second cut and ends next to the beginning of the first cut. The cuts form three flaps 21, 22 and 23 to the outside of the cuts, leaving the generally triangularly shaped opening or space 20 in the center of the coaster, with the apexes or points of the triangle curving to within about ¼ inch of the edge of the circle. The edges of the cuts and flaps are then suitably finished by applying stitching 24, for example, to prevent raveling and/or to provide a decorative look The two circles are then placed on top of one another, with the sides having the absorbent backing facing one another, and secured together at their periphery by suitable means, such as stitching 14.

The circles preferably have a diameter of about 3¾ inches, whereby the coaster will fit the base of typical stemware, which has a diameter of from about 1½ inch to about 3½ inch in diameter. It should be understood, however, that the coaster can have any size, as appropriate or desired.

The coaster is used by slipping the base of a stemmed glass under one flap and then folding back the coaster to allow the edge of the other two flaps to come up and over the top of the base. The base is then eased under the two flaps until the coaster is fitted smoothly onto the base. With the coaster in place, it will travel with the container and no further intervention is required by the user.

Although particular embodiments of the invention are illustrated and described in detail herein, it is to be understood that various changes and modifications may be made to the invention without departing from the spirit and intent of the invention as defined by the scope of the appended claims.

What is claimed is:

1. A coaster for stemware, comprising:

a flexible and absorbent bottom portion;

a flexible and absorbent top portion of substantially the same size and shape as the bottom portion;

said top and bottom portions being joined together at outer marginal edges thereof to define a substantially flat coaster having a hollow cavity between the top and bottom portions;

said top portion being provided with a plurality of shaped slots or cuts extending generally radially from adjacent a center of the top portion to adjacent an outer edge, the shaped cuts being generally wave shaped, with each wave-shaped cut starting near an edge of the coaster and continuing in an arc across the coaster so that a back side of the wave shape curves toward the center of the coaster with a crest of the wave near but spaced from the center of the coaster, and then curling around to finish near an edge of the coaster, with said plurality of cuts spaced substantially equidistantly around the coaster, and wherein each shaped cut starts next to the finish of a preceding adjacent cut; and a plurality of flays formed by said plurality of shaped cuts, leaving an opening in the center of the coaster through which a base of the stemware can be inserted into the hollow cavity, whereby the coaster is retained on the base.

2. A coaster as claimed in claim 1, wherein:

the top and bottom portions each comprise a fabric material.

3. A coaster as claimed in claim 2, wherein:

the coaster is circular to fit and conform to a circular base on stemware.

4. A coaster as claimed in claim 3, wherein:

the top and bottom portions are formed of two separate pieces of material secured together at their periphery.

5. A coaster as claimed in claim 1, wherein:

the coaster is circular, there are three equidistantly spaced wave shaped cuts, and said opening is generally triangular shaped, with the apexes or points of the triangularly shaped opening extending to adjacent the edge of the coaster.

6. A coaster as claimed in claim 1, wherein:

the coaster is made of a paper material.

7. A coaster as claimed in claim 4, wherein:

the top and bottom portions are secured together by stitching; and stitching is applied along the edges of the cuts.

8. A coaster as claimed in claim 7, wherein:

the fabric has a finished side and an absorbent side, and said top and bottom portions are secured together so that the absorbent sides face one another.

9. A coaster for stemware, comprising:

a circular bottom portion and a circular top portion joined at their periphery to define a substantially flat circular coaster having a hollow cavity between the top and bottom portions; and three equidistantly spaced wave shaped cuts formed in said top portion, extending generally radially from adjacent a center of the top portion to adjacent an outer edge, and defining a triangular shaped opening centrally in the top portion through which a base of the stemware can be inserted into the hollow cavity, whereby the coaster is retained on the base, said triangular shaped opening having apexes or points extending to adjacent the edge of the coaster.

10. A coaster as claimed in claim 9, wherein:

the coaster is made of a paper material.

11. A coaster as claimed in claim 9, wherein:

the coaster is made of a fabric material.

* * * * *